United States Patent [19]

Palm

[11] Patent Number: 4,655,603

[45] Date of Patent: Apr. 7, 1987

[54] PNEUMATIC MIXING APPARATUS FOR BULK MATERIALS AND FILTER APPARATUS THEREFOR

[75] Inventor: Hans-Günther Palm, Engelskirchen, Fed. Rep. of Germany

[73] Assignee: Madaus & Co., Cologne, Fed. Rep. of Germany

[21] Appl. No.: 716,857

[22] Filed: Mar. 28, 1985

[30] Foreign Application Priority Data

Mar. 31, 1984 [DE] Fed. Rep. of Germany ..... 3412000

[51] Int. Cl.[4] ..... B01F 13/02

[52] U.S. Cl. ..... 366/107; 55/302; 239/590.5

[58] Field of Search ..... 366/101, 102, 103, 104, 366/106, 107; 239/589, 590, 590.1; 55/302

[56] References Cited

U.S. PATENT DOCUMENTS

| | | | |
|---|---|---|---|
| 1,660,557 | 2/1928 | Heimburger | 239/589 |
| 3,179,379 | 4/1965 | Grun | 366/101 |
| 3,630,005 | 12/1971 | Reinauer | 55/302 |
| 3,733,784 | 5/1973 | Anderson | 55/302 |
| 3,874,857 | 4/1975 | Hunt | 55/302 |
| 3,973,935 | 8/1976 | Moore | 55/302 |
| 4,073,632 | 2/1978 | Reinauer | 55/302 |
| 4,168,913 | 9/1979 | Kono | 366/101 |
| 4,185,926 | 1/1980 | Lyon | 366/101 |

*Primary Examiner*—Robert W. Jenkins
*Attorney, Agent, or Firm*—Felfe & Lynch

[57] ABSTRACT

In a pneumatic mixing apparatus for bulk materials, filter apparatus comprises a plurality of tube filters which are disposed each beneath a reverse cleaning nozzle. Venturi nozzles fastened to a perforated plate project into each tube filter coaxially with the latter. An external supporting frame is also fastened to the perforated plate and at its bottom end embraces the tube filters in a plurality of coplanar rings affixed to one another.

5 Claims, 7 Drawing Figures

PNEUMATIC MIXING APPARATUS FOR BULK MATERIALS AND FILTER APPARATUS THEREFOR

This invention relates to a pneumatic mixing apparatus for bulk materials, preferably having in its upper portion a transverse perforated plate whose bores are concentric with cylindrical filter units fastened to and depending from the perforated plate, and preferably having above the perforated plate a plurality of reverse cleaning nozzles which are connected to compressed gas lines and are directed coaxially into the openings of the filter units and through which the reverse cleaning air can be introduced into the filter units. The invention also relates to filter apparatus for the pneumatic mixing apparatus.

Such pneumatic mixing apparatus for bulk materials, also called gas-jet mixers, serve for homogenizing and mixing bulk materials by means of gas jets.

A known pneumatic mixing apparatus comprises an upright cylindrical vessel with a conical bottom in whose lowermost area a ring of nozzles is situated for blowing in a mixing gas. In the upper cylindrical portion underneath the mixer cover there is an exhaust filter and a connection for the exhaust. The exhaust filter comprises a plurality of filter candle units with folded-paper filters, fastened to a perforated plate and depending therefrom. The filter candle units are concentric with the bores of the perforated plate and are open at the top. Compressed gas lines are fastened to the mixer cover, and from them connections extend coaxially into the openings of the filter candle units. Through these connections the cleaning air can be introduced for cleaning the folded-paper filters. During the mixing operation, the mixing gas is blown through the filter candle units and the exhaust connection. On account of the intense mixing of the bulk materials, whereby the entire content of the mixer is agitated shock-wise by means of pulsed gas jets, the folded-paper filters are often damaged. If the filter is destroyed, the material to be mixed can escape uncontrollably into the atmosphere through the exhaust connections. Also, the material, especially material in granular and dust form, collects between the individual folds of the paper filter. Thus, cleaning the filter by reverse blowing, which is initiated upon a specific loss of pressure on the filter, is interfered with to such an extent that an excessively great pressure rise in reverse blowing also results in destruction of the paper filter. If the filter is not destroyed, then at least reverse blowing is initiated at increasingly shorter time intervals by the excess pressure, since the pores of the paper filters increasingly clog up. The pneumatic mixing apparatus must then frequently be shut down and cleaned by reverse blowing, and then restarted. The rapid clogging of the pores of the paper filter and the increasing pressure loss this causes at the filter also necessitates frequent changing of the filters.

It is an object of the invention to provide a pneumatic mixing apparatus for bulk materials and filter apparatus therefor, which will permit a long filter life and operate with a low loss of pressure.

To solve this problem, provision is made in accordance with the invention for the filter units to comprise tube filters, and for a filter nozzle having two opposite, flaring nozzle portions to be fastened to the perforated plate coaxially with each tube filter and to extend into the latter.

The combination of the reverse cleaning nozzle, which introduces the cleaning gas at high pressure into the filter nozzle, constantly or pulsatingly, with the filter nozzle which increasingly accelerates the emerging cleaning gas in the narrowing nozzle cross section and then transforms the velocity of the cleaning gas into pressure for the counterflow cleaning of the filter tubes, makes possible a more concentrated guidance of the air in the reverse cleaning and hence, ultimately, a better distribution of pressure in the tube filter. This takes the stress off the fastening of the tube filter at its upper end and prevents damage to the filter medium by irregular pressure distribution, especially in the case of alternate stressing by a pulsed reverse cleaning gas stream. The improved pressure distribution in the tube filter assures a uniform and intensive cleaning of the filter medium. Since the filter units preferably comprise tube filters of substantially smooth cylindrical surface, it is mainly a surface filtration that takes place, so that the filter medium is especially easy to clean by reversal. By the improved cleaning of the tube filters and the avoidance of mechanical damage, a considerable increase in the life of the filter medium is achieved.

An advantageous development resides in the fact that the reverse cleaning nozzles preferably have two opposite, flaring nozzle sections and preferably are disposed at an axial distance from the filter nozzles. In this manner, the cleaning gas emerging from the reverse cleaning nozzles is concentrated, so that the reverse cleaning nozzle can be at a distance from the orifice of the filter nozzles, which can serve to provide the filter nozzle with a cylindrical upper portion to which the tube filters can be fastened in a simple manner.

A preferred embodiment of the invention is characterized by the fact that the filter nozzles preferably are Venturi nozzles whose nozzle section flares in the direction of the reverse cleaning nozzles. The cleaning gas flows contrariwise through the gradually flaring nozzle section, so that the cleaning gas is increasingly accelerated. The short inlet section of the Venturi nozzle causes a sudden expansion of the flow cross section in the direction of flow of the cleaning gas, resulting in an intense turbulence in the cleaning gas combined with a great decrease in velocity and a great increase in pressure. This leads to an especially intensive cleaning of the filter medium by the reverse-cleaning gas. During the filtering operation, the mixing gas flows through the Venturi nozzles in the opposite direction. The Venturi nozzles then have the advantage of causing little loss of pressure.

An advantageous further development of the invention provides for an outer supporting frame for the tube filters to be fastened to the perforated plate so as to hang downwardly therefrom and hold the bottom ends of the tube filters. The bulk material that is to be mixed is agitated by a high agitating pressure of 8 to 13 bar in a number of pulsating blasts of the mixing gas. At the same time the tube filters depending from the perforated plate are highly stressed mechanically on account of their great surface area which is attacked by the turbulent flow. The outer supporting framework of the tube filters makes it possible to assure, in an advantageous manner, that the tube filters will remain substantially in their vertical dependent position both during the cleaning with a pulsating cleaning gas stream and during mixing with a pulsating and rotating mixing gas stream, so that mechanical damage, especially to the filter medium, is prevented and the life of the tube filter is considerably extended.

Preferentially, provision is made for the supporting frame to consist, at its bottom end embracing the ends of the tube filters, of a plurality of rings disposed in one plane and fastened together. This brings it about that each individual tube filter is held apart from the adjacent tube filters, and that the supporting frame itself is given a greater strength on account of the fastening together of the rings. In particular, forces of the turbulent flow exerted against the supporting frame which act upon opposite radial portions of the tube filter unit cancel one another. The tube filters held steady in the holders can perform no more than a slight fluttering movement, which reduces greatly the possibility of mechanical damage to the tube filter.

A preferred embodiment of the invention has a filter medium made of a polyester fabric or a cotton and polyamide fabric. These filter media permit long life and low pressure loss on the filter.

In accordance with the invention, in pneumatic mixing apparatus for bulk materials having a vessel which has in its upper portion a perforated plate whose bores are disposed concentrically with cylindrical filter units fastened dependingly from the perforated plate, and which has above the perforated plate a plurality of reverse cleaning nozzles connected to one or more compressed gas lines, the nozzles pointing coaxially into the openings of the filter units and the reverse cleaning air being introduceable into the filter units through the nozzles, filter apparatus comprises a plurality of two filters and filter nozzles. Each filter nozzle has two opposed, flaring nozzle portions and the filter nozzles are fastened to the perforated plate coaxially with the tube filters and extend into the tube filters.

Also in accordance with the invention, pneumatic mixing apparatus for bulk material comprises a vessel which has an upper portion and which has in its upper portion a perforated plate having bores. The apparatus also includes a plurality of cylindrical filter units fastened dependingly from the perforated plate and disposed concentrically with the bores. Each filter unit comprises a tube filter and a filter nozzle having two opposed, flaring nozzle portions fastened to the perforated plate coaxially with the tube filter and extending into the tube filter. The apparatus also includes a plurality of reverse cleaning nozzles above the perforated plate and connected to one or more compressed gas lines. The reverse cleaning nozzles point coaxially into the filter units and reverse cleaning air is introduceable into the filter units through the reverse cleaning nozzles.

For a better understanding of the invention, together with other and further objects thereof, reference is made to the following description, taken in connection with the accompanying drawings, and its scope will be pointed out in the appended claims.

Referring now to the drawings.

Figure 1:
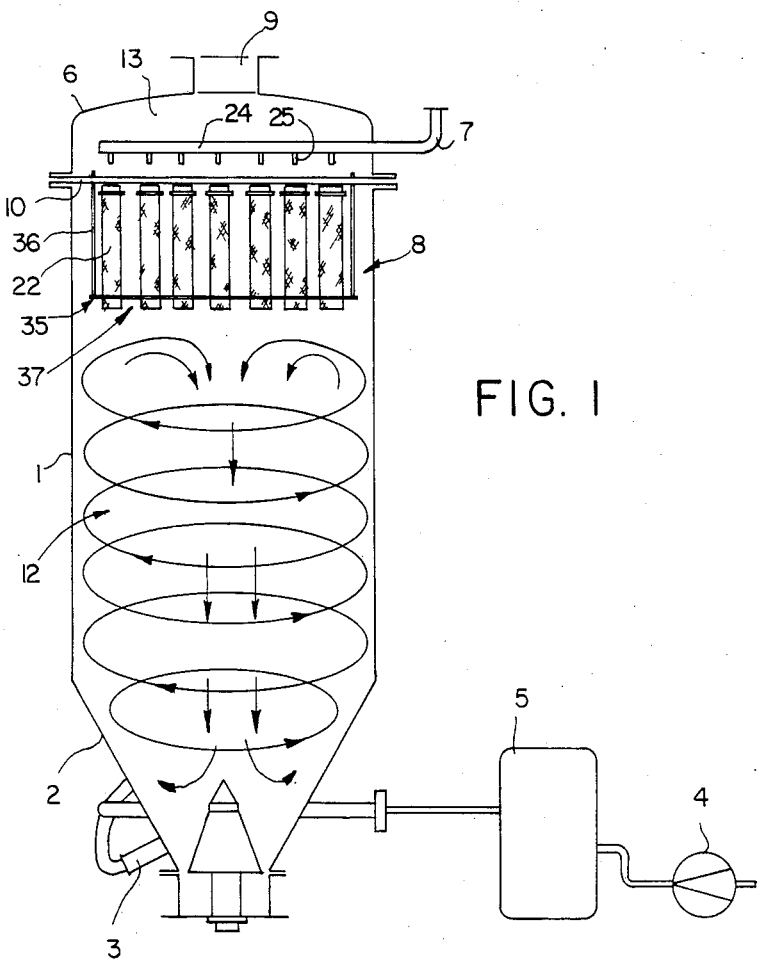
FIG. 1 shows, partly diagramatically, a pneumatic mixing apparatus having Venturi nozzles disposed in tube filters.
Figure 2:
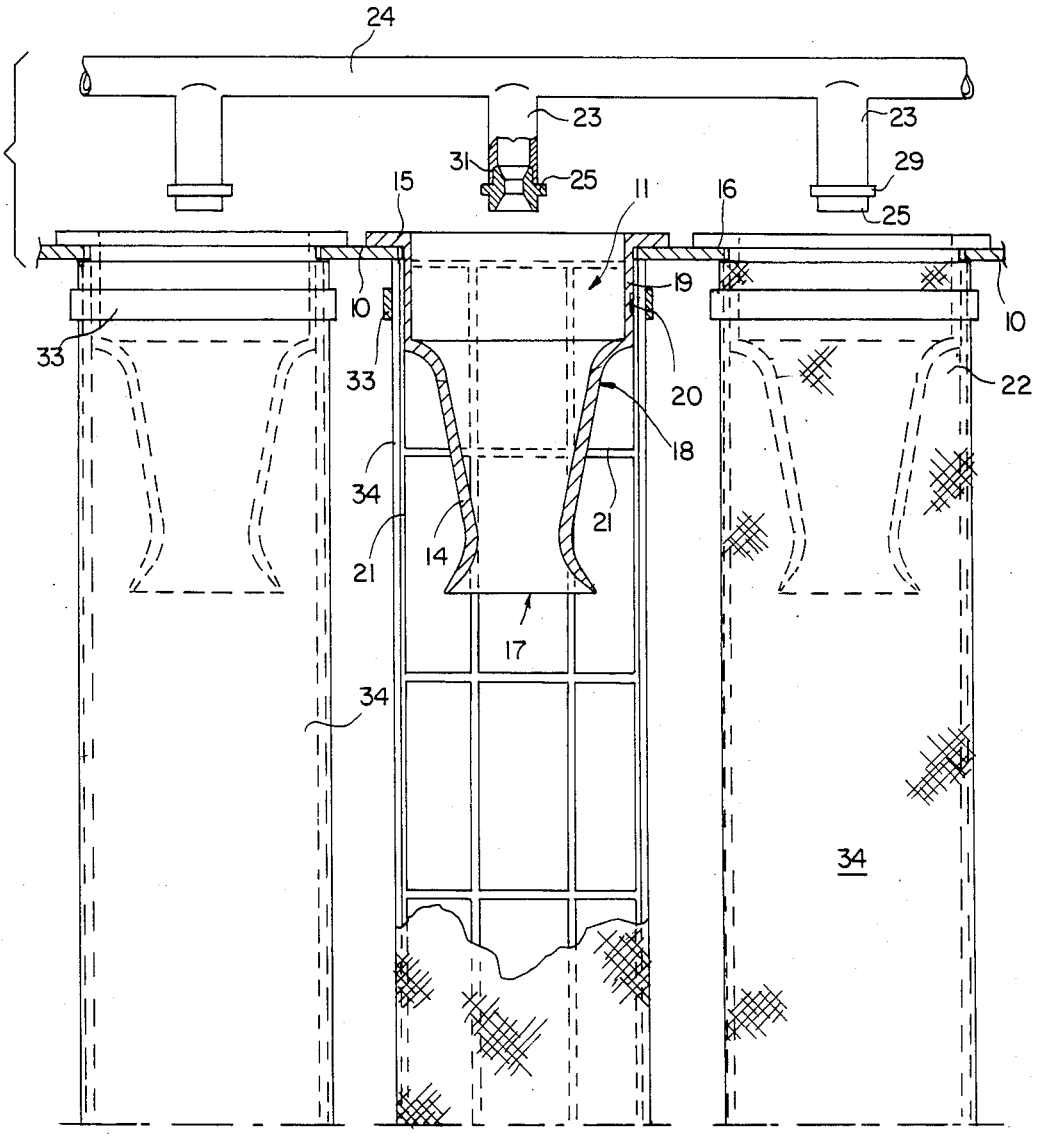
FIG. 2 shows, in a fragmentary, enlarged sectional view of the FIG. 1 embodiment, the disposition of the reverse cleaning nozzle in relation to the filter nozzle.
Figure 3A:
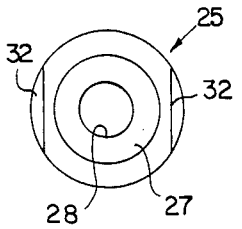
Figure 3B:
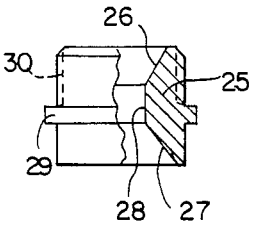
Figure 3C:
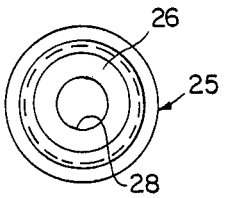
Figure 4:
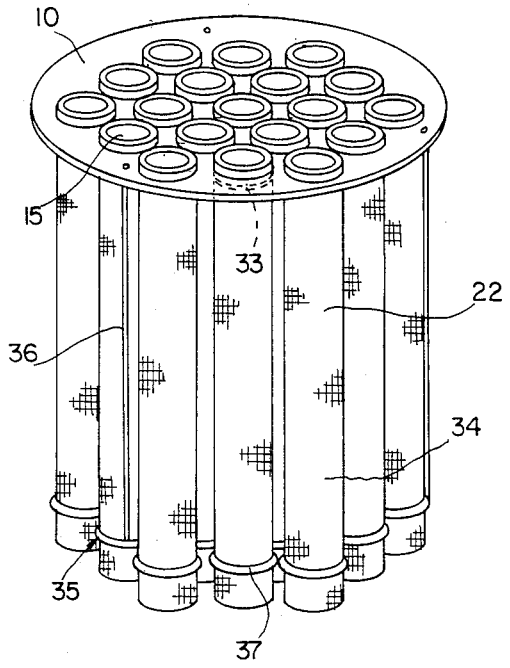

FIGS. 3*a*, 3*b* and 3*c* show bottom plan, side elevational (with fragmentary sectional view) and top plan views of the reverse cleaning nozzle;

FIG. 4 is a perspective representation of the supporting frame; and

Figure 5:
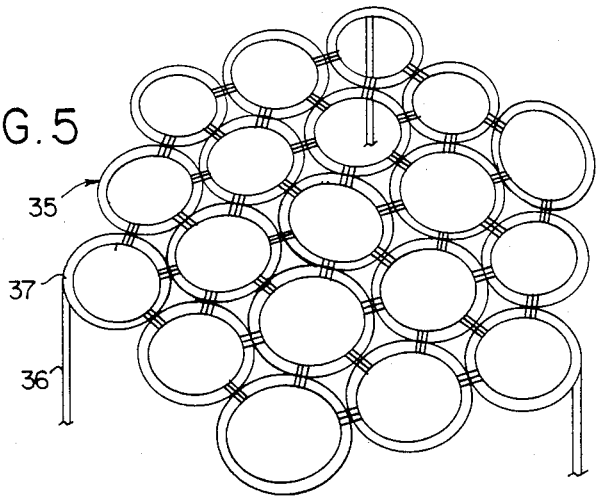

FIG. 5 is a fragmentary, perspective representation of the supporting frame as seen from the bottom.

The pneumatic mixing apparatus preferably comprises an upright cylindrical vessel 1 with a conical bottom 2 for discharge. In the lowermost portion of the bottom 2 there preferably is a ring of nozzles 3 including feed lines and shutoffs for the mixing gas. The mixing gas preferably is delivered by a pump 4 and a pressure tank 5 to the nozzles 3. The upper portion of the cylindrical vessel 1 preferably is closed by a removable mixer cover 6. The mixer cover 6 preferably has one or more inlets 7 having pneumatically operated shutoffs, through which a gas under pressure can be injected into the upper portion of the cylindrical vessel 1 to clean a filter apparatus 8. Also, a connection 9 coaxial with the vessel 1 preferably projects upwardly for the exhaust.

The vessel 1 preferably has in the plane of contact with the mixer cover 6 a perforated plate 10 with a total of nineteen bores 11 which preferably are disposed in a symmetrically spaced-apart relationship in the form of a hexagon, each side of the hexagon preferably being formed by three bores 11 arranged in a line, and the diagonals running through the corners preferably being formed by five bores 11 arranged in line. The perforated plate 10 preferably tightly separates a lower mixing region 12 in the vessel 10 from an upper cleaning gas region 13 underneath the mixer cover 6.

Preferably in each bore 11 of the perforated plate 10 a Venturi nozzle 14 hanging downwardly from the cleaning gas area 13 into the mixing area 12 is fastened on the upper side of the perforated plate 10. The Venturi nozzle 14 preferably has on its one end a flange 15 with a total of eight bores distributed uniformly around its circumference whereby the Venturi nozzle 14 can be bolted or screwed to the perforated plate 10. An annular gasket 16 preferably is disposed between the flange 15 of the Venturi nozzle 14 and the perforated plate 10. At the end of the Venturi nozzle 14 remote from the flange 15 there preferably is a rounded conical inlet 17 which reaches as far as the narrowest nozzle cross section. After the narrowest cross section the Venturi nozzle 14 gradually expands in a nozzle portion 18 which preferably leads into a cylindrical nozzle portion 19 terminating in the flange 15.

The hollow cylindrical nozzle portion 19 preferably is provided with an external annular groove 20 which can accommodate an O-ring gasket or into which a matching portion of an internal supporting frame 21 of a tube filter 22 can snap. A supporting frame 21 in the form of an internal frame preferably is pushed over the cylindrical nozzle section 19. A filter medium 34 preferably can then be slipped over the internal supporting frame 21, and preferably can be clamped, together with the upper end of the supporting frame 21, to the hollow cylindrical nozzle section 19 by a hose clamp 33.

Cleaning gas nipples 23 preferably are disposed coaxially with the Venturi nozzles 14 at a distance above the latter, in the cleaning gas region 13, and preferably project downwardly from horizontally disposed pressure lines 24 connected to the inlet opening 7. Each cleaning gas nipple 23 preferably has at its extremity a reverse cleaning nozzle 25 which is screwed into the cleaning gas nipple 23 and preferably has two oppositely flaring nozzle portions 26 and 27 and a straight nozzle passage between them. The reverse cleaning nozzle 25 preferably has in the middle of its length an annular flange 29 from which a male thread 30 runs to one end. The male thread 30 of the reverse cleaning nozzle 25 preferably serves for screwing the reverse cleaning nozzle 25 into a corresponding female thread 31 in the cleaning gas nipple 23. On the end of the reverse cleaning nozzle 25 opposite the male thread 30 two parallel surfaces 32 preferably are cut on opposite sides into the outer periphery of the reverse cleaning nozzle to enable the latter to be driven with an open-end wrench.

In addition to the Venturi nozzles 14, an external supporting frame 35 preferably is fastened to the perforated plate 10 by means of a total of, for example, three posts 36 depending from the outer margin of the filter units 8, parallel to the tube filters 22. A total of nineteen rings 37, corresponding to the nineteen tube filters 22, preferably are affixed in one plane to the bottom ends of the three supporting posts 36, by welding for example. The arrangement of the rings 37 preferably is the same as the arrangement of the bores 11 in the perforated plate 10, the bores and rings 37 being concentric with one another. The three posts 36 are preferably disposed at an equal distance apart at three corners of the hexagon formed by the rings 37. The posts 36 are furthermore preferably shorter than the tube filters 22, so that each individual ring 37 embraces one tube filter 22 at its lower end, each tube filter 22 preferably being held at a single, defined distance from the adjacent tube filters. The rings 37 preferably are made of a rod material of round cross section, so that, even when the turbulence in the mixing chamber 12 is intense, the filter media 34 stretched on the internal supporting frame 21 cannot be damaged. To replace the filter medium 34 it preferably is necessary only to release the hose clamp 33 below the perforated plate 10 at the level of the cylindrical nozzle section 19, while the outer supporting frame 35 can be left mounted on the perforated plate 10.

The filter medium preferably comprises a polyester fabric or a cotton and polyamide fabric. These fabrics have a high tear strength and, since they have a low resistance to the flow of air, they assure a low pressure loss at the filter.

The apparatus described makes it possible to mix and homogenize a finely granular bulk material, such as a powder, especially powdered materials of different grain sizes or different substances. In order to mix the materials, the latter are dumped into the vessel through appropriate pneumatically operated inlet valves (not represented). The mixing chamber 12 can be filled to about 60 to 70%, depending on the gas-holding capacity of the material. Then the mixing process is started by an automatically operating electro-pneumatic control system. The mixing gas, which is compressed and stored in the pressure tank 5, is released into the mixing chamber 12 of the vessel 1 through a shutoff means, such as a ball valve, and several nozzles 3. The turbulence required for the mixing is achieved by the pulsed injection of the mixing gas through the nozzles 3, producing at the outer periphery of the vessel 1 a spirally ascending vortex, namely a turbulence source, and in the inner part a contrarily descending vortex, namely a turbulence sink. The intensive mixing is based, therefore, on the shock-wise, complete stirring up of the entire mixer content by the pulsed jets of mixing gas. The mixing gas expanding to a slight residual pressure in the vessel 1 escapes, in the case of finely granular material, through the filter units 8 and the connection 9 to the exterior, the current passing through the tube filter 22 from the outside in, while the material is deposited on the smooth, cylindrical outside surface of the filter medium. After flowing through the filter medium, the gas stream passes through the Venturi nozzle 14 into the cleaning gas region 13 where it can escape through the connection 9.

During filtration, the finest particles of the material become held in the pores of the filter medium, so that the pressure drop on the filter medium increases. If this pressure drop reaches a certain limit value, a reverse cleaning process must be initiated in order to restore the permeability of the filter medium. For this purpose, first the mixing process is interrupted and the mixing gas stream is shut off. Then a reverse cleaning gas is introduced pulsatingly through the inlet opening 7, passes through the pressure lines 24 to the cleaning gas nipples 23, and emerges through the reverse cleaning nozzles 25 and is injected in a concentrated jet into the Venturi nozzle 14. The Venturi nozzle 14 accelerates the cleaning gas stream up to its narrowest cross section, and then, due to an expansion of the nozzle cross section, a velocity-pressure transformation takes place, so that the tube filters are cleaned by a pulsating reverse flow at high pressure, as the filter pores are blown free. The narrow focusing of the reverse cleaning blast produces a uniform distribution of pressure within the tube filter 22. On the basis of the cleaning of the tube filters 22 optimized by means of the reverse cleaning nozzles 25 and the filter nozzles 14, and on the basis of the use of cotton-and-polyamide or polyester filter media, the pressure in the mixing apparatus can be dropped during the mixing process to 0.05 bar with an unvarying throughput of mixing gas. The average pore size of the 2-mm thick filter medium preferably is 1 micrometer and the pore volume of the filter medium preferably is 83%.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Pneumatic mixing apparatus for bulk materials comprising:

a vessel which has an upper poriton and which has in its upper portion a perforated plate having bores;

a plurality of cylindrical filter units fastened dependingly from said perforated plate and disposed concentrically with said bores, each filter unit comprising a tube filter and a filter nozzle having two opposed, flaring nozzle portions fastened to said perforated plate coaxially with said tube filter and extending into said tube filter;

a plurality of reverse cleaning nozzles above said perforated plate and connected to one or more compressed gas lines, said reverse cleaning nozzles pointing coaxially into said filter units and reverse cleaning air being introducible into said filter units through said reverse cleaning nozzles, said reverse cleaning nozzles each comprising two opposite flaring nozzle portions and being disposed at an axial distance from said filter nozzles.

2. The filter of claim 1, in which said filter nozzles are Venturi nozzles, each having a gradually expanding nozzle portion pointing in the direction of a reverse cleaning nozzle.

3. The apparatus of claim 1, in which said tube filters have bottom ends and which comprises an outer supporting frame for said plurality of tube filters and which is fastened to the perforated plate and which depends from the perforated plate and embraces said bottom ends of said plurality of tube filters.

4. The apparatus of claim 3, in which said supporting frame has a bottom end and comprises at its bottom end embracing said tube filter ends a plurality of rings disposed in one plane, which are affixed to one another.

5. The apparatus of claim 1, in which said tube filter comprises a filter medium selected from the group consisting of a polyester fabric and a cotton and polyamide fabric.

* * * * *